US006250033B1

(12) United States Patent
Zelinsky

(10) Patent No.: US 6,250,033 B1
(45) Date of Patent: Jun. 26, 2001

(54) VERTICAL AND HORIZONTAL FORMING MEMBERS FOR POURED CONCRETE WALLS

(75) Inventor: Ronald D. Zelinsky, Terril, IA (US)

(73) Assignee: Insulated Rail Systems, Inc., Terril, IA (US)

( * ) Notice: Subject to any disclaimer, the term of this patent is extended or adjusted under 35 U.S.C. 154(b) by 0 days.

(21) Appl. No.: 09/487,465

(22) Filed: Jan. 19, 2000

(51) Int. Cl.[7] ..... E04B 2/86
(52) U.S. Cl. ..... 52/275; 52/268; 52/426
(58) Field of Search ..... 52/426, 442, 275, 52/265, 267, 268, 269, 309.17; 249/33, 34, 38, 216, 218

(56) References Cited

U.S. PATENT DOCUMENTS 3,483,665 * 12/1969 Miller ..... 52/275
5,649,401 * 7/1997 Harrington, Jr. ..... 249/47
5,992,114 * 11/1999 Zelinsky et al. ..... 52/426

* cited by examiner

*Primary Examiner*—Michael Safavi

(57) ABSTRACT

Forming members for pouring of concrete walls which members hold sheets or material in spaced relation to one another to provide a concrete receiving space therebetween. In a horizontal mode, a base member having a web with U-shaped channels at the respective ends thereof is secured to a poured or otherwise formed foundation and a first course of insulating or other material sheet is placed in the U-channels. The forming members include H-shaped elements on the respective ends of a web to be received upon the upper edge of the first course of sheets, thus lying horizontal, to receive another course of sheets in alignment thereabove. This formation extends upwardly with sheets received into each H-shaped element. A second U-channeled web caps the sheets upon proper wall height being reached. In a vertical mode, a U-channeled web is positioned on the foundation mounted member and sheets are again provided with the arrangement of the H-web forming elements now being vertical to receive the ends of such sheets and, again, upon reaching proper wall height, a second U-web is placed on the uppermost sheet course. In either horizontal or vertical positioning of the H-shaped webs, a corner bracket, each providing a pair of U-channels, either web joined or tie bar joined, receives the ends of all sheets to form the corner. The corner brackets will normally only be arranged in a vertical position.

9 Claims, 5 Drawing Sheets

VERTICAL AND HORIZONTAL FORMING MEMBERS FOR POURED CONCRETE WALLS

RELATED APPLICATIONS

Applicant is only aware of his co-pending application upon which the Final Fee has been paid, entitled Apparatus for Forming a Poured Concrete Wall; U.S. Ser. No. 09/058, 933; Filed: Apr. 13, 1998. He is not aware of any other application by any other party that should be considered.

SPONSORSHIP

This invention has not been made under any Federal or Independent Sponsorship and is the sole result of his own inventive efforts.

FIELD OF THE INVENTION

This invention relates generally to the construction aspect of forming poured concrete walls where the elements defining the concrete receiving cavity are formed from sheets of selected materials which are held in spaced relation through a combination of U and H-shaped web structures with additional corner members which similarly may be web joined, stand alone without joinder or are tie joined. Supporting sheets of selected materials are positioned within the U and H-shaped structures and corner members to define the concrete receiving cavity and the sheets may selectively remain in the finished wall with the remaining U, H-shaped structures and corner members remaining in the wall as attachment areas for additional wall coverings. The J-shaped member may be arranged either horizontally or vertically.

SHORT SUMMARY OF THE INVENTION

In the pouring of concrete walls as, typically in constructing of basements, a foundation, is initially provided with the wall being poured thereon and upwardly therefrom In a first form of the invention, defining a horizontal usage, a base or first web member having U-shaped channels on its respective sides is anchored to the foundation with sheets of select materials being inserted therein as a first course. Comer posts, each consisting of a pair of U-shaped channels, arranged at some selected angle to one another, for example a 90 degree or less or greater angle, are arranged at corner locations to receive the ends of sheets of material. These corner posts may be joined in some manner or may be free standing. Upon the upper side edges of the first course of sheets, a web member having H-shaped channels is positioned to receive an additional sheet course. Progress to desired wall height is achieved through subsequent courses of sheets and H-shaped web members with a final U-shaped web member positioned on the uppermost of such courses.

In a second form of the invention which does not require different structural elements, but for differentiation defining a vertical usage, the initial U-channeled web is positioned on the foundation to) receive the first course of sheet material with the corner posts again located at respective corners to receive the ends of sheets. In this form, H-webbed channels are placed at the end of a first sheet of material to receive with additional sheets and H channels arranged along the length of wall. The sequence of structure extending from one corner to another is the positioning of the -shaped web upon the foundation, placement of sheets therein with an H-shaped web, now vertically positioned atop the U-Web and receiving the end of a sheet. This procedure extends the length of the wall and following the first course, the corner posts and vertical H-webs are positioned and the sheets are simply slide into the provided spacings.

Upon reaching desired height, a topping U-web caps the final sheet.

In each application, cutting of the webs and corners must taken into consideration.

BACKGROUND AND OBJECTS OF THE INVENTION

The formation of poured concrete walls is not new. The art of doing the same has changed from time-to-time, dependent upon the growth of material technology and, simply, more awareness and development of building techniques.

This is represented by the number of Prior Art references which have been cited in the Prior Art Statement.

Applicant is well aware of structures that included cross ties between the cavity providing sheets and his previous invention was directed to such a concept.

The present invention is believed to be a new and unique system which eliminates cross or tie bar connections, with the exception of and the only possible necessity being at the corner post locations.

The U and H channel members each provide a continuous, cuttable, member with the U and H openings of the channel members being selectively spaced with respect to one another for determination of the width of the concrete wall to be poured. This allows for extrusion of these members as well as the corner units which substantially reduces the cost of materials involved and reduces labor by elimination of tie or cross bar placement.

It is therefore an object of the Applicant's invention to provide vertically and horizontally positionable sheet supporting and locating elements which are designed to hold cavity forming sheets in predetermined spaced position to ultimately provide a concrete receiving cavity.

It is a further object of the Applicant's invention to provide a first web having U-shaped channels on the respective sides of the web to afford a bottom and a capping or top member for positioning of sheets of material for forming a concrete receiving cavity.

It is a further object of the Applicant's invention to provide a second web having H-shaped channels on the respective sides of the web which may be utilized in either horizontal of vertical position to receive either edges or ends of sheets of material to form a concrete receiving cavity for forming a poured concrete wall It is still a further object of the Applicant's invention to provide a corner member to receive the ends of sheets of material and hold the same in spaced relation to one another with each corner including a pair of U-shaped members desired at a desired corner forming angle, each corner requiring a pair of such members which may be joined through either a web or connective elements.

These and other objects and advantages of the Applicant's invention will more fully appear from a consideration of the accompanying description and drawings

SHORT DESCRIPTION OF THE DRAWINGS

DESCRIPTION OF A PREFERRED EMBODIMENT OF THE INVENTION

Figure 1:
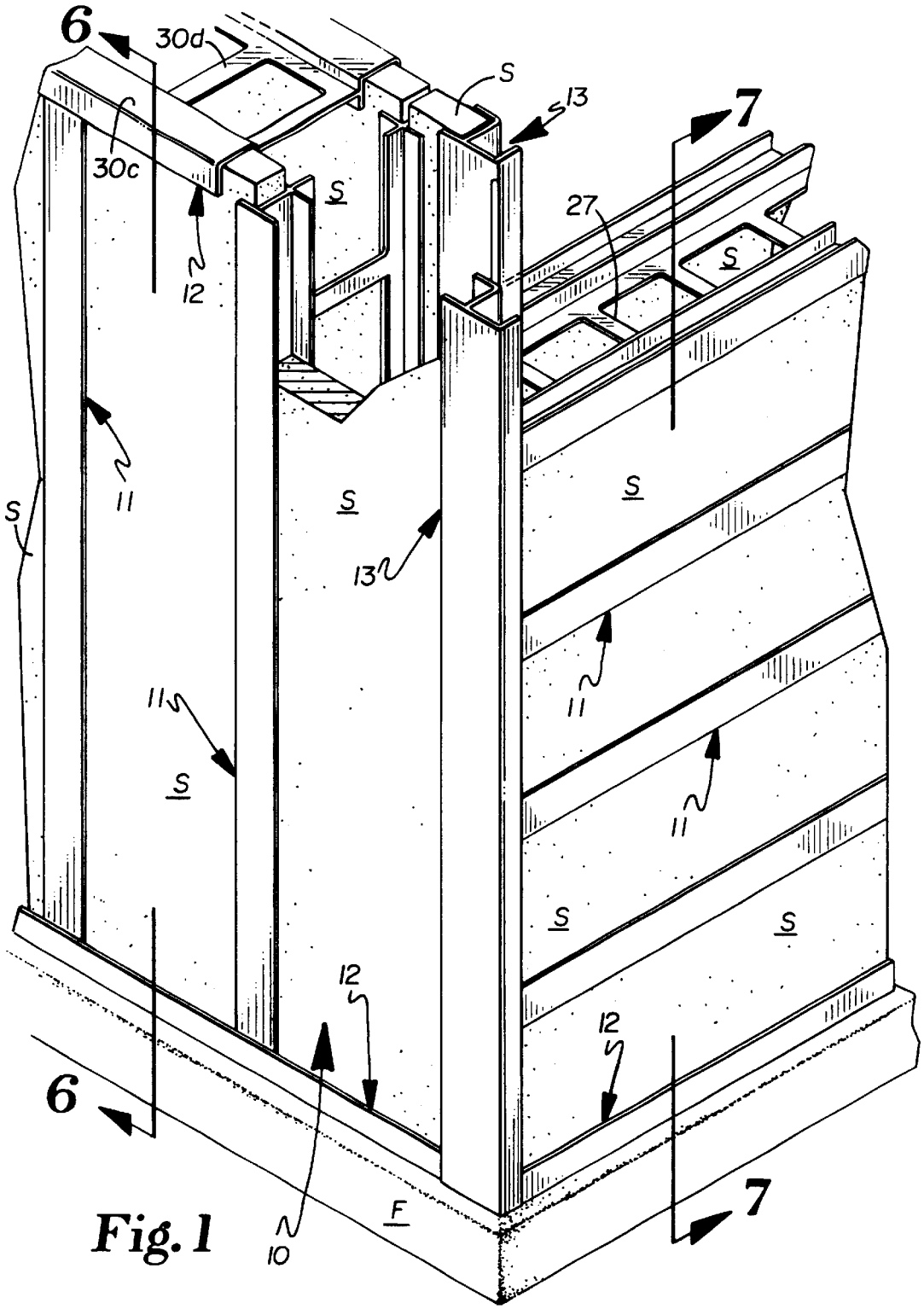
FIG. 1 is a perspective view of a right angle corner of a concrete cavity providing structure which includes all the elements necessary to construct such a cavity prior to pouring of FIG. 2 is a top plan view of a typical corner section.

In accordance with the accompanying drawings the structure for forming a concrete receiving cavity for the formation of a poured concrete wall is generally designated 10 and is illustrated as being positioned upon a foundation F. The foundation may take any of several forms such as a framed and poured concrete structure, compacted earth structure, stone base or all of which will provide a firm structurally sound footing for the erection of a structure and permit location of the final wall thereon.

The applicant has chosen to illustrate a typical corner of a wall as this is illustrative of all of the elements for forming the wall with it being understood that a typical basement or the like will consist of at least three such walls and each will employ a variety of the elements described and illustrated herein.

Applicant has also chosen, for the sake of simplicity, walls which include vertical and horizontal elements and corner sections A typical, either vertically or horizontally positionable H-shaped, webbed channel is generally dented 11. A typical horizontally positionable U-shaped, webbed or unwebbed channel is generally dated 12 and a corner, double U-shaped channel, either webbed or tie joined, is generally designated 13.

The specific details and illustrative cross sections of these individual elements is illustrated in FIGS. 3, 4, 5, 6 and 7.

As illustrated in FIGS. 2, 3, 4, 5 and particularly 2 and 5, the double U-shaped channel 13 consists of a pair of U-shaped members 14, 15 each of which is provided with a common side 16, with, in one case, a pair of legs 14*a*, 14*b* forming with said common side 16, a U-shaped channel and in the other case, a pair of legs 15*a*, 15*b* forming, with said common side 16, a second U-shaped channel As illustrated, these channels are arranged at tight or normal angles such that sheets of material S received into each of such Us will form a right angle corner. Obviously, not all walls demand right angle corners and therefore this angle may be modified without departing from the scope of the invention.

Figure 3:
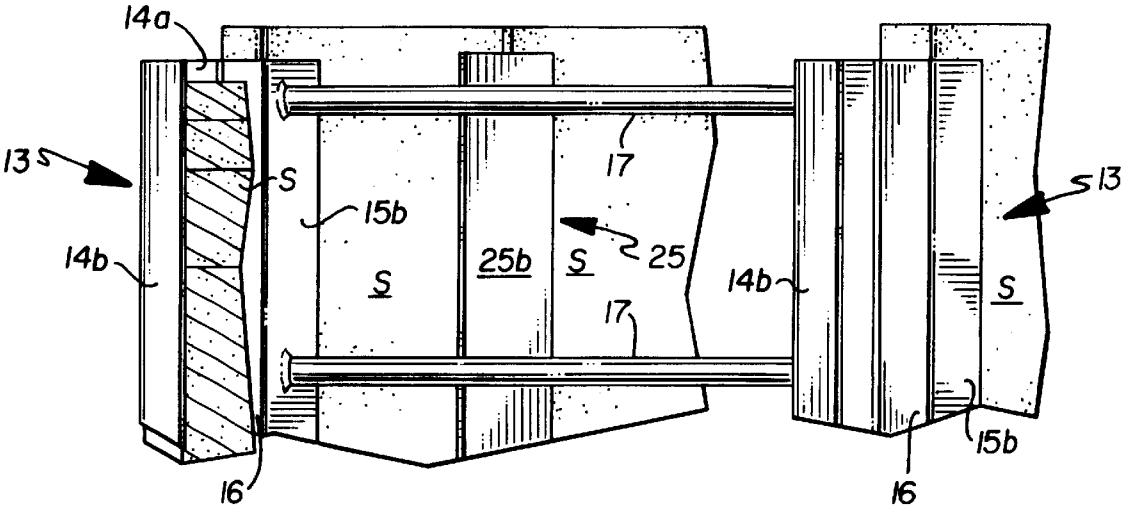
FIG. 3 is a vertical section taken substantially along Line A—A of FIG. 5 showing a web connection between corners.
Figure 4:
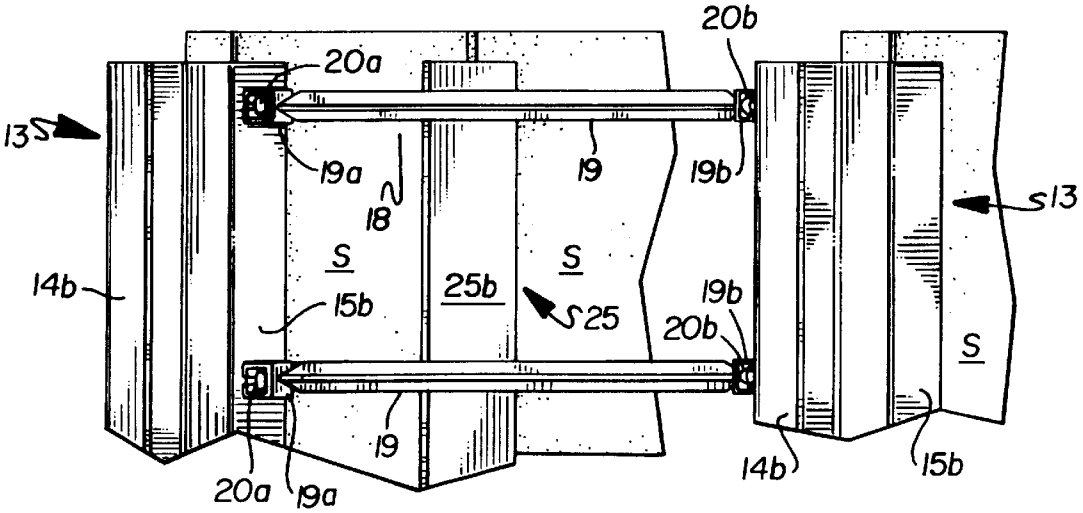
FIG. 4 is a view similar to FIG. 3 but illustrating a tie bar connection between corners.
Figure 5:
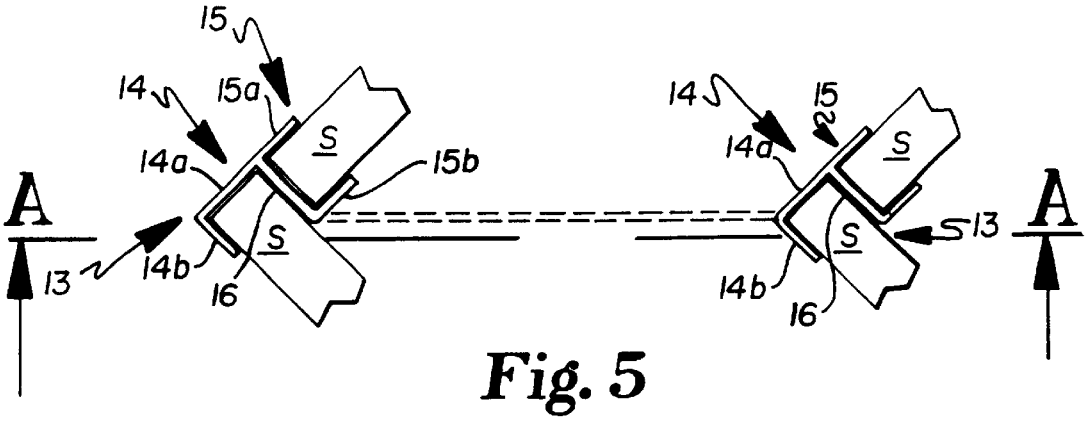
FIG. 5 is a top view illustrating a typical corner with a dotted line illustrating the connection between corners.

Two of such corners 13, are provided for each corner to position the inner and outer walls forming the concrete pouring cavity and separate means for joining the same are illustrated in FIGS. 3 and 4.

As illustrated in FIG. 3, a plurality of webs or cross members 17 are provided to extend between the corner pairs 13 and when extrusion forming such joined unit, the webs 17 are provided by punching out or otherwise removing unwanted material from the extrusion.

A alternative connector arrangement, illustrated in FIG. 4, is provided. A plurality of cross tie members, generally 18, are positionable between such corners 13 and to effect this arrangement, the innermost area of one corner is provided with a boss 20*a* with the outermost area of the other corner also being provided with a boss 20*b*. This boss may provided either a male or female component for connection to the tie bar 19 which is similarly provided with male or female components 19*a*, 19*b* on the respective ends thereof for attachment to such bosses 20*a*, 20*b* .

Applicant has also found that, dependent upon the desired wall thickness and upon the size of sheets S, that the webs 17 or tie bars and connectors 19, 20 may be eliminated with positioning of these corner elements being provided through exterior braces.

Figure 2:
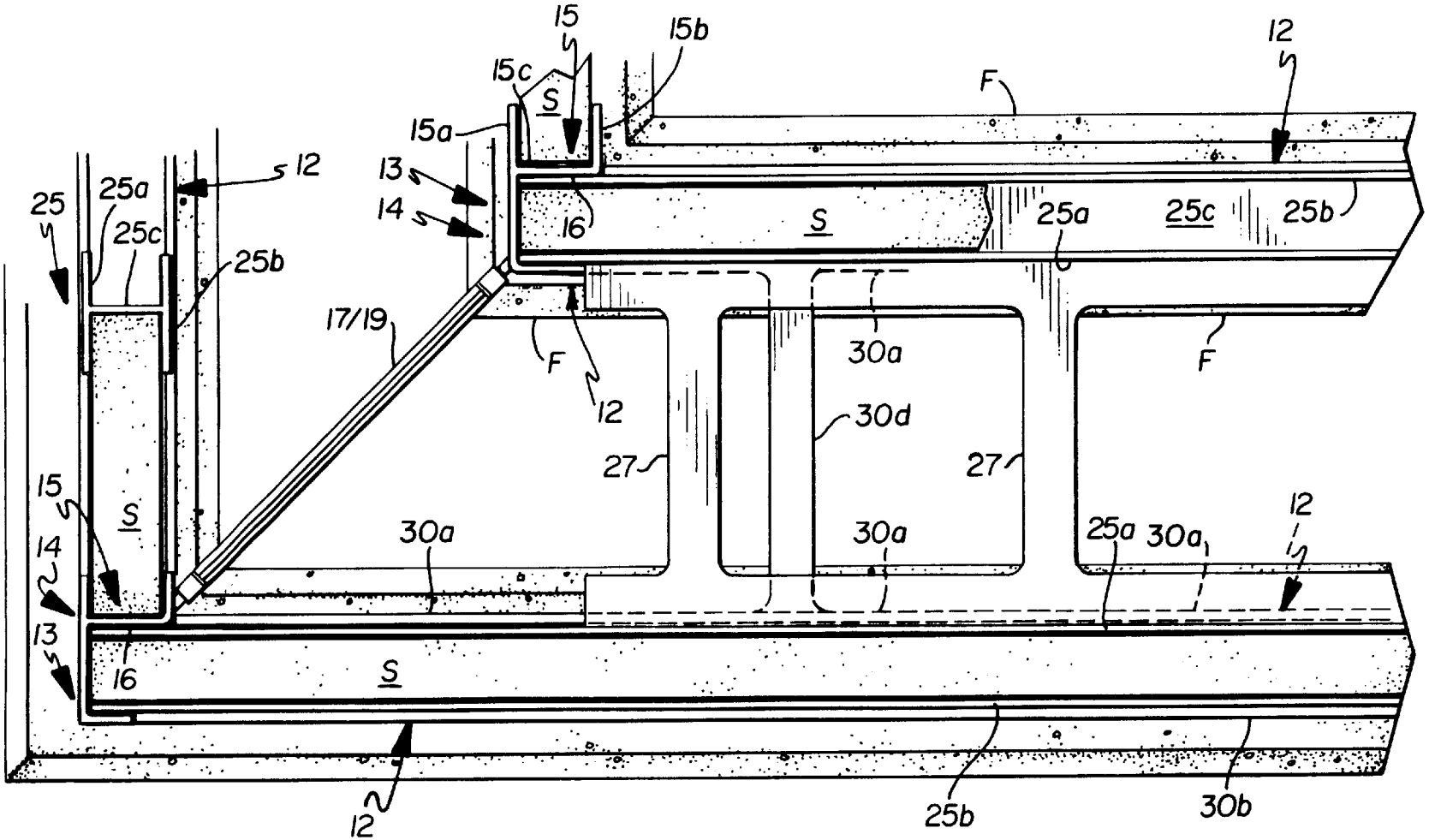
Figure 7:
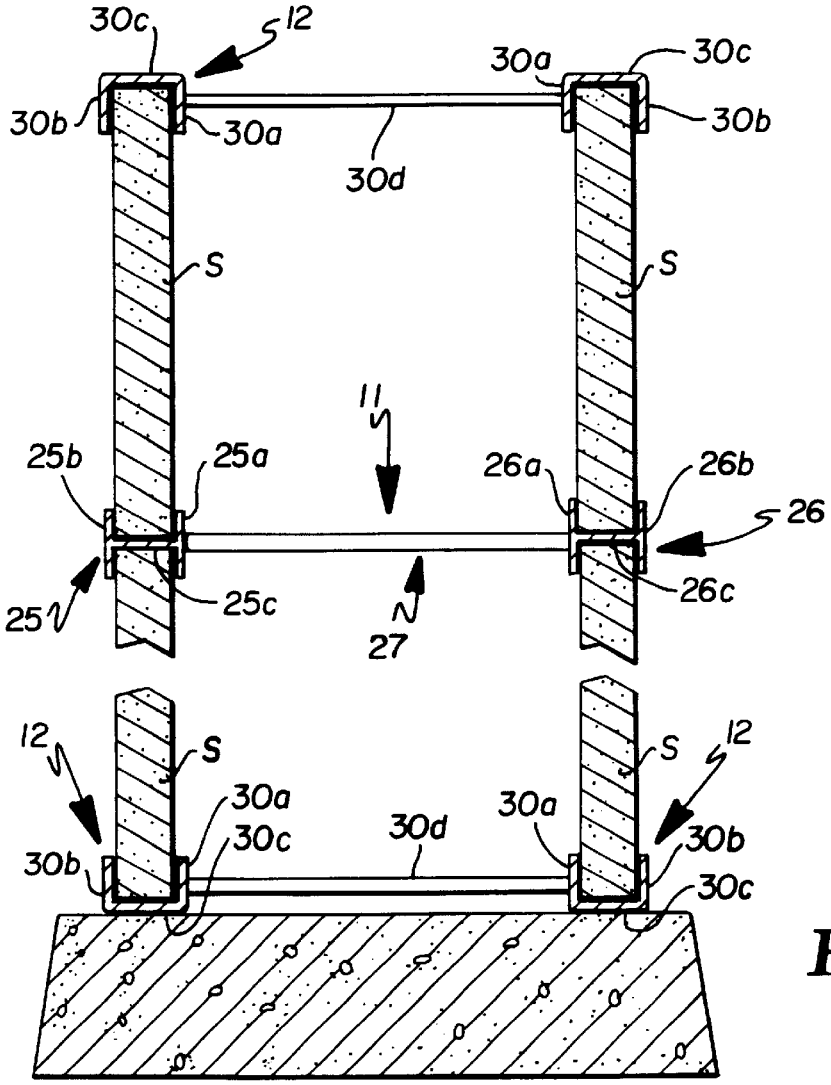
Figure 6:
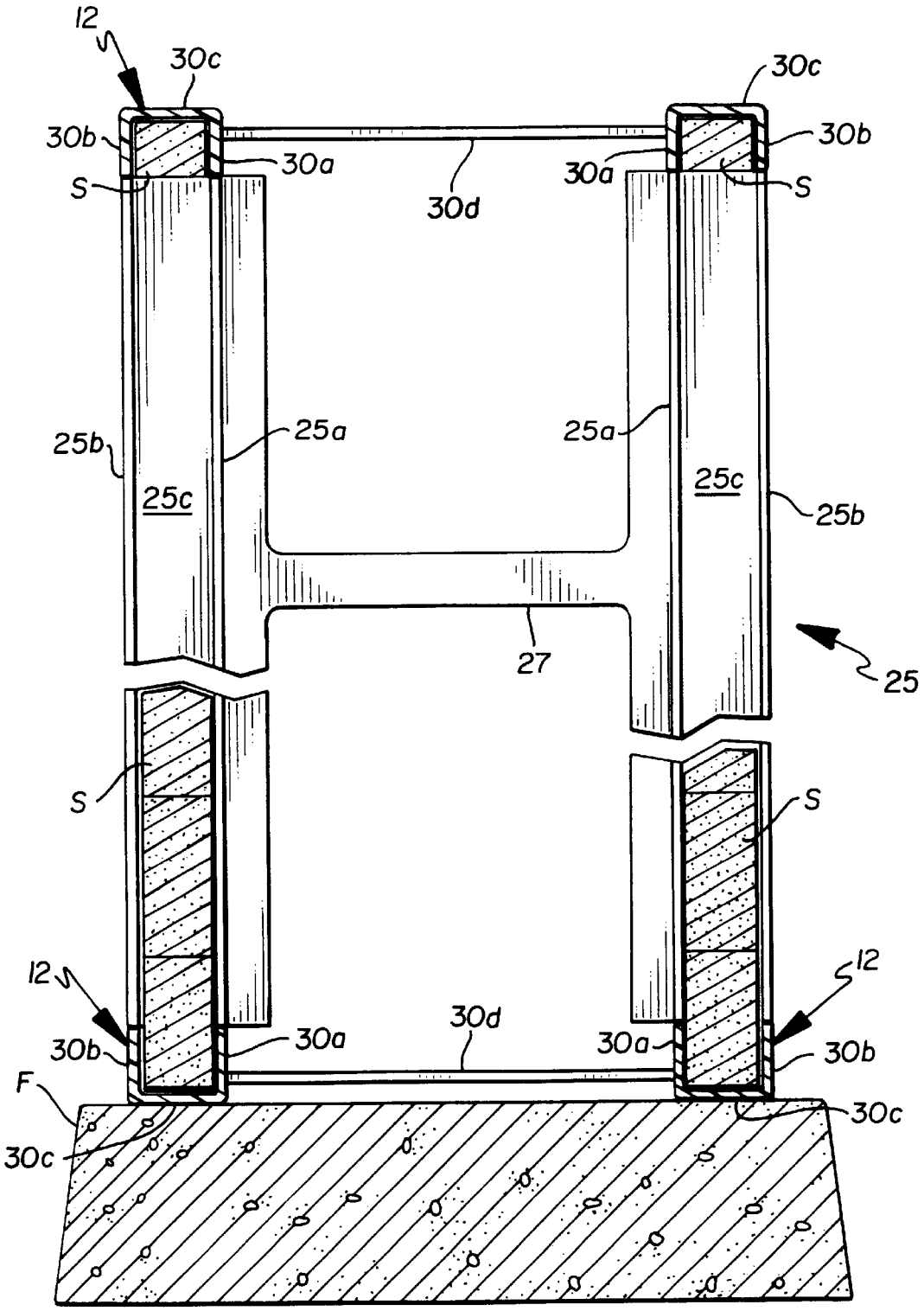
FIG. 6 is a vertical section taken substantially along Line 6—6 of FIG. 1 illustrating the vertical placement of the H-shaped channel members; and, FIG. 7 is a vertical section taken substantially along Line 7—7 of FIG. 1 illustrating the horizontal placement of the H-shaped channel members.

The horizontally or vertically useable H-shaped, web joined, channel 11 is best illustrated in FIGS. 2, 6 and 7. FIG. 6 particularly illustrates portions of sheets S along portions of the channel 11. As illustrated therein each channel 11 includes a pair of H-shaped members 25, 26 joined through a web portion 27. In turn, each of the H-shaped members 25, 26 includes an inner 25*a*, 26*a*, wall and an outer 25*a*, 26*b* wall connected through cross element 25*c*, 26*c* to provide a pair of opposed sheet S receiving areas whether such H is arranged horizontally or vertically. Either the ends or the side edges of such sheets S are received therein.

As illustrated in FIG. 2, the web portion 27 simple provides a connective element between these two formed H-shaped members 25, 26 and it is immaterial as to the open area provided between such members 25, 26 as long as it is sufficient for the flow of the concrete being poured.

The U-shaped channels 12 are best illustrated in FIGS. 6 and 7. As shown therein, each of such channels simple provides a U-shaped sheet receiving area providing a pair of spaced walls 30*a*, 30*b* joined through connector section 30*c*. The two formed areas are then, selectively joined by a cross or tying bar 30*d*. This bar 30d is considered essential for the uppermost wall topping U member but in normal installations, the bottommost or first U member is secured to the footing at the desired wall width and is not provided with bar 30*d*. Connector bar 30*d* occurs at spaced intervals along the length of the U member to, again, allow concrete pouring areas for introduction of material into the formed cavity. Applicant has further found that when the U-shaped channel 12 is utilized at the uppermost edge of the wall, the connector bars are not U-shaped required, dependent upon desired wall thickness.

In construction of a cavity for pouring of the concrete wall, a foundation F is initially provided and the first U-shaped channel 11 is positioned thereon. If the particular channel 11 is of the web form, distance between channels is preset. If unwebbed, the channels 11 are positioned and positively located in their desired location to provide a finished wall of proper thickness.

After setting the first such U-shaped channel or channels, the corner member 13 is abutted against the upper edge thereof and, if independent or tie member connected, will be supported during wall construction while the same will be relatively self supporting if web connected.

Sheets of selected materials then are positioned with their edges in the respective channels of the U with the ends of such sheets S being located in the receiving cavities of the same.

If the H-shaped members 11 are utilized horizontally, they are simple placed upon the upper edge of such sheets S with their ends abutting the corner members 13.

If the H-shaped members 11 are utilized vertically, they are placed in position to receive the end of a sheet S and rest upon the upper edge of the U-shaped channel 12.

If horizontal, additional courses of sheets S with alternate H-shaped channels 11 are assembled.

If vertical, the spacing between H-shaped channels 11 defines the length of a sheet S.

When the desired wall height is obtained, a capping U-shaped channel 12 is positioned upon the upper edge of the last sheet S.

The completed unit then provides a concrete receiving cavity which will have the sheets S as the exterior sides thereof in conjunction with the exposed portions of the U and H channels. It should be noted that these exposed U and H shaped channels are then available for attachment of further wall coverings if desired, although, dependent upon design considerations, sizing of the channels of the U and H channels could provide a totally complete and finished interior or exterior wall surface.

Though the drawings illustrate both horizontal and vertical H channel utilizations, it should be obvious that either one may be utilized or even combinations of both may be utilized in a single wall.

The disclosure then provides the structures necessary for the formation of a concrete receiving cavity which obviously may be modified without departing from the scope of the invention which is particularly set forth in the following claims.

What is claimed is:

1. Structures for forming a cavity to receive concrete therein to form a concrete wall on a footing, the structures including:

a. a first pair of upwardly directed, sheet receiving, U-shaped channel members positionable upon a footing and attachable thereto at a predetermined spacing corresponding to the width of the desired wall;

b. a plurality of channel members, each providing a pair of H-shaped, sheet receiving members, each said pair of H-shaped members including an integrally formed connective member therebetween which connective member provides spaced apertures to allow the passage of concrete therethrough;

c. vertical corner members positionable at desired corners of the wall to be formed and each including;

1) two pairs of U-shaped, panel receiving members, each pair of panel receiving members angularly arranged with respect to one another to form a corner of desired angularity;

2) means for maintaing spacing between said pairs of U-shaped, panel receiving members in accordance with the desired wall width and providing apertures therebetween to allow passage of concrete therethrough to fill the formed corner;

d. generally rectangular sheets of selected material having edges and ends, having one edge thereof receivable into said first pair of U-shaped channel members and having ends receivable into said vertical corner members and providing an upper edge to be received into said H-shaped members whereby said sheets may be upwardly positioned into said H-shaped members whereby said sheets may be positioned with respect to said first pair of U-shaped channel members, subsequent H-shaped channel members said corner members to a desired height; and, e. a second pair of U-shaped channel members arranged on the upper edge of the sheets upon the cavity being formed to a desired height.

2. The structures as set forth in claim 1 and said first pair of U-shaped channel members being attached to one another in spaced apart relation.

3. The structures as set forth in claim 1 and integrally formed connector means provided between said second pair of U-shaped channel members, said connector means providing concrete passing passages therethrough whereby concrete may be poured through said second pair of U-shaped channel members for filling the formed cavity.

4. The structures as set forth in claim 1 and said second (set) pair of U-shaped channel members being joined (together) in spaced apart relation through connector means and providing concrete flow passages between said connector (members) means and said second pair of U-shaped channel members.

5. The structures as set forth in claim 1 and said pairs of U-shaped panel receiving members of said corner members being joined together in spaced apart relation through connector means and providing concrete flow passages between said connector members.

6. The structures as set forth in claim 5 and said connector means being integrally formed with said U-shaped panel receiving members.

7. The structures as set forth in claim 6 and said connector means including:

a. a positionable tie member having, selectively, male and female connector ends; and, b. said corner members having, selectively, male and female connector portions to allow joinder of said pairs of U-shaped members.

8. The structures as set forth in claim 1 wherein said H-shaped channels are arranged in generally horizontal position between and receiving edges of said sheets of material.

9. The suctures as set forth in claim 1 wherein said H-shaped channels are arranged in generally vertical position to receive the ends of said sheets.

* * * * *